US007378798B2

(12) United States Patent
Coumans et al.

(10) Patent No.: US 7,378,798 B2
(45) Date of Patent: May 27, 2008

(54) ELECTRIC LAMP

(75) Inventors: Jacobus Johannes Chretien Coumans, Eindhoven (NL); Marten Willem Schuiteman, Eindhoven (NL); Wilhelmus Jacobus Johannes Welters, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 31 days.

(21) Appl. No.: 10/516,550

(22) PCT Filed: May 21, 2003

(86) PCT No.: PCT/IB03/02280

§ 371 (c)(1),
(2), (4) Date: Dec. 2, 2004

(87) PCT Pub. No.: WO03/105177

PCT Pub. Date: Dec. 18, 2003

(65) Prior Publication Data

US 2005/0174058 A1 Aug. 11, 2005

(30) Foreign Application Priority Data

Jun. 7, 2002 (EP) ..... 020777226

(51) Int. Cl.
*H01J 17/02* (2006.01)
*H01J 5/50* (2006.01)

(52) U.S. Cl. ..... 313/626; 313/318.07; 313/331; 313/333

(58) Field of Classification Search ..... 313/626, 313/331–332, 315, 318.07, 333; 174/50.52, 174/50.64, 50.6, 50.59
See application file for complete search history.

(56) References Cited

U.S. PATENT DOCUMENTS

| | | | | |
|---|---|---|---|---|
| 3,105,867 | A | 10/1963 | Meijer | |
| 3,235,379 | A * | 2/1966 | Scruggs | 75/232 |
| 3,420,944 | A | 1/1969 | Richard et al. | |
| 3,868,277 | A * | 2/1975 | Leroy et al. | 419/7 |
| 3,932,198 | A * | 1/1976 | Schneider | 148/265 |
| 3,959,682 | A | 5/1976 | Wesselink et al. | |
| 4,015,165 | A | 3/1977 | Hardies | |
| 4,145,631 | A * | 3/1979 | Saito | 313/315 |
| 4,777,404 | A | 10/1988 | Kiesel et al. | |
| 2002/0008477 | A1 | 1/2002 | Leichtfried et al. | |

FOREIGN PATENT DOCUMENTS

GB 688859 A 3/1953

* cited by examiner

*Primary Examiner*—Nimeshkumar D. Patel
*Assistant Examiner*—Anne M Hines

(57) ABSTRACT

An electric lamp has a lamp vessel accommodating an electric element. The element is connected to current conductors including molybdenum portions which have a coating of material chosen from the group of chromium-manganese, chromium-cobalt, chromium-iron and chromium-boron alloys as a protection against oxidation.

7 Claims, 1 Drawing Sheet

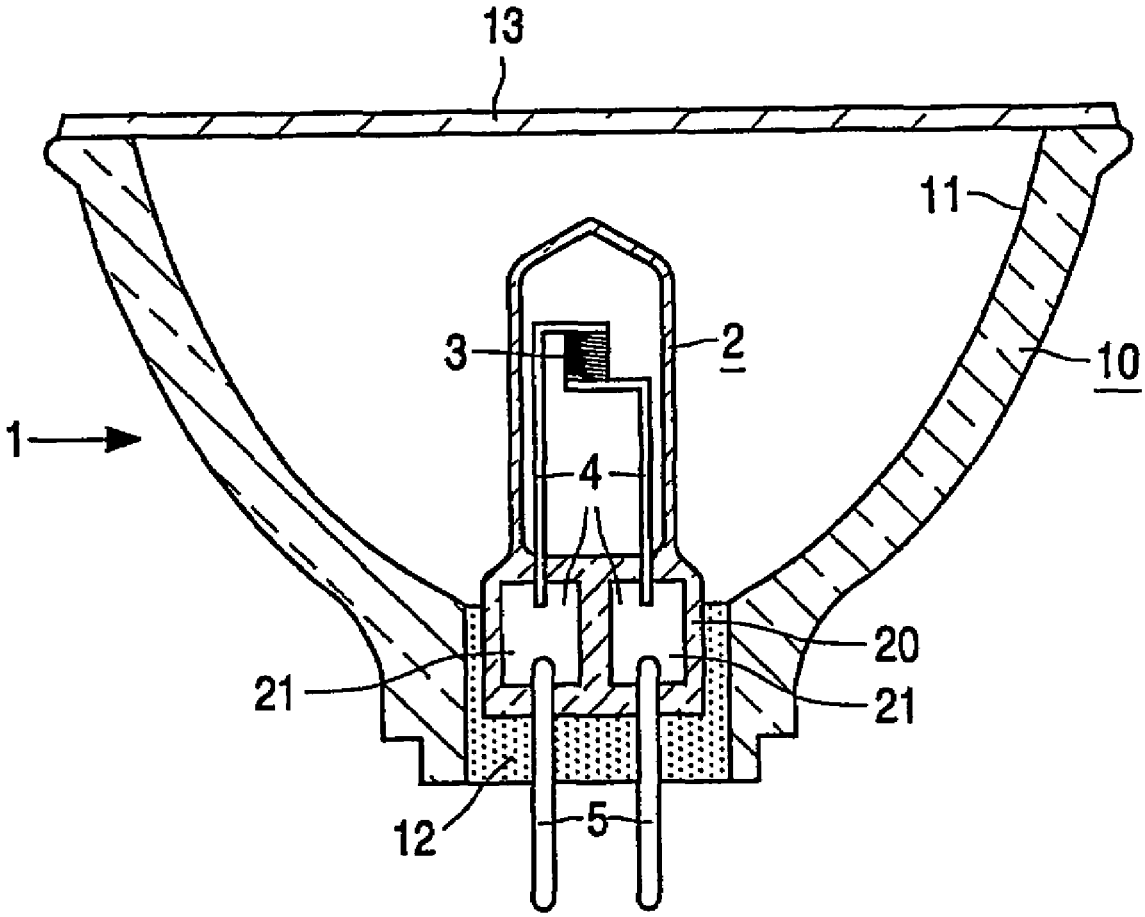
13
11
3
2
10
1
4
20
21
21
12
5

ELECTRIC LAMP

The invention relates to an electric lamp comprising:

a glass lamp vessel which is closed in a gastight manner by means of a seal and which contains an electric element, current conductors made at least partly from molybdenum and connected to said electric element, which conductors are partly embedded in the seal and are partly provided with means for protection against oxidation.

Such an electric lamp is known from U.S. Pat. No. 2002/0008477.

Current conductors with one or several molybdenum foils embedded in the seal are often used in electric lamps because molybdenum is well resistant to high temperatures as regards its mechanical loading capacity, and because molybdenum has a coefficient of thermal expansion which matches that of hard glass and which deviates little from that of quartz glass, i.e. glass with an $SiO_2$ content of at least 95% by weight. It is a disadvantage of molybdenum, however, that it oxidizes easily, which involves a considerable risk of the electrical contact being broken, for example to the connection terminals of a lamp holder, and of stresses and/or fractures arising in the glass portions of the seal.

According to the cited patent, the current conductors are provided with a coating of chromium or a nickel-chromium alloy. The known lamp, however, has the disadvantage that there is a comparatively bad adhesion between the foil and the glass in which the foil is embedded if a chromium coating is used. If a nickel-chromium alloy coating is used in the known lamp, there is a better adhesion between the foil and the glass, but the known lamp then has the disadvantage of an increased tendency to develop fractures in the current conductors.

It is an object of the invention to provide an electric lamp of the kind described in the opening paragraph in which the above disadvantages are counteracted.

According to the invention, this object is achieved in that the electric lamp of the kind described in the opening paragraph is characterized in that the means for protection against oxidation are chosen from the group of materials formed by chromium-manganese, chromium-cobalt, chromium-iron, and chromium-boron alloys.

The coating may be provided on the entire foil or only on those portions of the foil which are in contact with the atmosphere outside the lamp, or alternatively it may also be provided on the external current conductor connected to the foil. A well covering coating of chromium-manganese, chromium-cobalt, chromium-iron, and chromium-boron alloys is not only easier to realize than one with pure chromium, but the coating is also effectively active against oxidation. The coating is especially effectively active against oxidation at elevated temperatures, for example up to approximately 550° C., in which case the alloy may have a chromium content of 99 down to less than 50 atom percents. Chromium-manganese, chromium-cobalt, chromium-iron, and chromium-boron alloys in addition have the advantage that they do not lead to an increased brittleness of the molybdenum portion and that they are also thermally stable at very high temperatures, for example 2000° C. Thermal stability at very high temperatures means also that no dissociation of the bonds, whereby compounds unsuitable for oxidation-resistant coatings are formed, takes place as a result of the high temperature. This renders these compounds suitable for coatings on metal parts which are effective against oxidation, for example in lamps, for example quartz glass lamps, in which very high temperatures are used in the lamp manufacturing process. Furthermore, the alloys have the advantage that, unlike chromium, the alloys melt during the manufacture of the lamp. The molten alloy then distributes itself over the Mo and thus ensures a better covering and protection by the layer on the molybdenum foil. It was furthermore found in experiments that a good adhesion between the molybdenum foil and the glass is achieved with these alloys, especially good results being obtained with the chromium-manganese alloy.

It was also found in particular that the coating of the relevant portions with chromium alloys having a chromium content of between 80 and 99 atom percents has a comparatively good effect because a top layer of chromium is formed on the coating by the alloy during lamp manufacture in the case of such a chromium content. Such a chromium content thus achieves a favorable combination of the effectively covering coating owing to flowing of the alloy over the molybdenum foil and the favorable oxidation protection properties of the chromium top layer.

In a preferred embodiment, the alloy for protecting the molybdenum foil against oxidation contains 94 to 96 atom percents of chromium. It was found in experiments that an alloy having such a chromium content can be provided comparatively easily as compared with the alloys having a lower or higher chromium content.

Preferably, the coating has a layer thickness of at least 1 μm and at most 6 μm. A layer thickness smaller than 1 μm gives an insufficient protection of the molybdenum against oxidation. A layer thickness greater than 6 μm is unnecessarily expensive because no improved protection against oxidation is obtained with respect to a coating having a layer thickness of 6 μm. In addition, a thicker metal layer leads to a reduced mechanical strength of the lead-through and to an increase in the risk of the lamp exploding.

The oxidation-resistant coating on the molybdenum portion may be readily obtained in a plating process, for example an electroplating process from aqueous solutions of metal salts. The advantage of a plating process is that the metals of the alloy may be provided either simultaneously or successively. It is alternatively possible to obtain the oxidation-resistant coating by means of a CVD process. The electroplating process and the CVD process both have the advantage that the coating is provided on all sides. CVD, however, is a comparatively expensive process compared with electroplating. The metal may alternatively be provided by means of PVD, but this process is both comparatively expensive compared with electroplating and is incapable of providing a coating on all sides in one process step.

In spite of the protection against oxidation provided by the coating of chromium-manganese, chromium-cobalt, chromium-iron, and chromium-boron alloys, the protected portion can be processed in a conventional manner, for example in that it is welded to a metal foil, for example to a molybdenum foil on which the gastight seal of the lamp vessel is realized. A good electrical connection can be realized on the protected portion, for example by means of contacts of a lampholder, which connection has a resistance value that is only a few mΩ higher than those of platinum or platinum-coated portions.

The electric element of the lamp may be a pair of electrodes in an ionizable gas or an incandescent body, for example in an inert gas comprising a halogen. The lamp vessel may have one or several seals from (each of) which a respective current conductor issues to the exterior. The lamp vessel, for example made of quartz glass or hard glass, may be joined together with a reflector body into a lamp.

An embodiment of the electric lamp according to the invention is shown in longitudinal section in the drawing.

In the FIGURE, the electric lamp 1 has a quartz glass lamp vessel 2 which is closed in a gastight manner and which contains an electric element 3, an incandescent body in the FIGURE, and a reflector body 10 having a mirroring surface 11 and a transparent plate 13. The lamp vessel 2 is fixed in the reflector body 10 by means of cement 12. Current conductors 4 extending through a seal 20 are connected to the electric element 3. Each current conductor has a foil 21 embedded in the seal and an end portion 5 of molybdenum extending beyond the lamp vessel 2. Both the foil 21 and the end portion 5 have means for protection against oxidation. Said portions 5 and 21 for this purpose have a coating of an alloy of chromium with 5 atom percents of manganese. The coating has a layer thickness of approximately 2.5 μm. The end portions 5, which act as contact pins for the lamp, are welded to the foils.

Oven experiments were carried out with halogen lamps, which were exposed to air at 530° C. The halogen lamps are lamps of the SSTV type (Stage Studio Theater and Video lamps) having a power rating of 1 kW and a lamp voltage of 220 V. It was demonstrated in these oven experiments that the lamps according to the invention provided with coatings of an alloy of chromium with 5 atom percents of manganese on the current conductors have current conductors that have a considerably better oxidation resistance. The current conductors, passed 6 times through the oven, are resistant to the imposed high temperature of 530° C. more than twice as long as current conductors of a known lamp provided with chromium coatings on portions corresponding to the portions 5 and 21 of FIG. 1, i.e. 1677 hours against 642 hours.

The lamp shown may be used, for example, for accent lighting, for projection applications, or for photo, video, or movie takes.

The invention claimed is:

1. An electric lamp comprising:

a glass lamp vessel which is closed in a gastight manner by means of a seal and which contains an electric element, current conductors made at least partly from molybdenum and connected to said electric element, which conductors are partly embedded in the seal and at least those portions which are in contact with the atmosphere outside the lamp are provided with means for protection against oxidation, wherein the means for protection against oxidation includes chromium-boron alloy.

2. The electric lamp as claimed in claim 1, wherein the alloy contains 80 to 99 atom percents of chromium.

3. The electric lamp as claimed in claim 1, wherein the alloy contains 94 to 96 atom percents of chromium.

4. An electric lamp comprising:

a glass lamp vessel which is closed in a gastight manner by means of a seal and which contains an electric element, current conductors made at least partly from molybdenum and connected to said electric element, which conductors are partly embedded in the seal and at least those portions which are in contact with the atmosphere outside the lamp are provided with means for protection against oxidation, wherein the means for protection against oxidation are chosen from the group of materials formed by chromium-manganese, chromium-cobalt, chromium-iron, and chromium-boron alloys, and wherein the coating has a layer thickness of at least 1 μm and at most 6 μm.

5. An electric lamp comprising:

a glass lamp vessel which is closed in a gastight manner by means of a seal and which contains an electric element, current conductors made at least partly from molybdenum and connected to said electric element, which conductors are partly embedded in the seal and at least those portions which are in contact with the atmosphere outside the lamp are provided with means for protection against oxidation, wherein the means for protection against oxidation are chosen from the group of materials formed by chromium-manganese, chromium-cobalt, and chromium-boron alloys, wherein the means for protection against oxidation is a coating.

6. An electric lamp comprising:

a glass lamp vessel which is closed in a gastight manner by means of a seal and which contains an electric element, current conductors made at least partly from molybdenum, and connected to said electric element, which conductors are partly embedded in the seal and are partly provided with means for protection against oxidation, means for protection against oxidation being chosen from the group of materials formed by chromium-manganese, chromium-cobalt, chromium-iron, and chromium-boron alloys, wherein the alloy contains 80 to 99 atom percents of chromium.

7. The electric lamp as claimed in claim 6, wherein the alloy contains 94 to 96 atom percents of chromium.

* * * * *